US008974260B1

(12) United States Patent
Davidson

(10) Patent No.: US 8,974,260 B1
(45) Date of Patent: Mar. 10, 2015

(54) CUTTER ASSEMBLY FOR A MOTOR PROPELLER

(71) Applicant: Charles Davidson, Concord, CA (US)

(72) Inventor: Charles Davidson, Concord, CA (US)

( * ) Notice: Subject to any disclaimer, the term of this patent is extended or adjusted under 35 U.S.C. 154(b) by 0 days.

(21) Appl. No.: 14/069,692

(22) Filed: Nov. 1, 2013

(51) Int. Cl.
*B63H 1/28* (2006.01)
*B63H 5/16* (2006.01)

(52) U.S. Cl.
CPC ..... *B63H 5/165* (2013.01)
USPC ..... 440/73

(58) Field of Classification Search
CPC ..... B63H 5/165
USPC ..... 440/73
See application file for complete search history.

(56) References Cited

U.S. PATENT DOCUMENTS

| | | | | | |
|---|---|---|---|---|---|
| 2,470,874 | A | | 5/1949 | Sidney | |
| 3,802,377 | A | | 4/1974 | Porter et al. | |
| 3,859,953 | A | | 1/1975 | Todt | |
| 3,965,845 | A | | 6/1976 | Lubov | |
| 4,070,984 | A | | 1/1978 | Kappas | |
| 4,450,670 | A | * | 5/1984 | Robinson | 56/8 |
| 4,507,091 | A | * | 3/1985 | Govan | 440/73 |
| 4,544,363 | A | * | 10/1985 | Govan | 440/73 |
| 4,565,533 | A | | 1/1986 | Springer | |
| 4,578,040 | A | * | 3/1986 | Sumino et al. | 440/73 |
| 4,609,361 | A | * | 9/1986 | Sumino et al. | 440/73 |
| 4,676,758 | A | * | 6/1987 | Dennis | 440/73 |
| 4,718,871 | A | | 1/1988 | Mendelevitch | |
| 4,801,281 | A | * | 1/1989 | Govan | 440/73 |
| 4,902,255 | A | | 2/1990 | Faunda | |
| 4,925,412 | A | | 5/1990 | Karls | |
| 4,943,249 | A | * | 7/1990 | Govan | 440/73 |
| 4,954,108 | A | * | 9/1990 | Govan | 440/73 |
| 5,007,867 | A | | 4/1991 | Kelley | |
| 5,017,167 | A | * | 5/1991 | Govan | 440/73 |
| 5,052,957 | A | * | 10/1991 | Govan | 440/73 |
| 5,462,462 | A | | 10/1995 | Woodley | |
| 5,993,274 | A | | 11/1999 | Rising et al. | |
| 6,004,174 | A | * | 12/1999 | Govan | 440/73 |
| 6,247,980 | B1 | | 6/2001 | Moore et al. | |
| 7,488,226 | B2 | | 2/2009 | Perkins, II | |
| 7,581,995 | B1 | * | 9/2009 | Govan | 440/73 |
| 2009/0129930 | A1 | | 5/2009 | Janitz | |

* cited by examiner

*Primary Examiner* — Daniel V Venne
(74) *Attorney, Agent, or Firm* — Charles L. Thoeming

(57) ABSTRACT

A cutter assembly includes cutting blades spaced equidistant around a motor housing cover. The blades' cutting edges are orthogonal to a plane rotated around a housing centerline axis. Each cutting blade is ninety degrees from its adjacent cutting blades with respect to the housing centerline axis, and forty-five degrees from an axis orthogonal to the housing centerline. An embodiment includes a hinged cylindrical cover blade base locking around the housing for existing motor housings. Each cutting blade provides a forward oriented surface having a convex portion, an aft oriented surface having a convex portion, and a tip end. An embodiment provides a cutting blade tip end angle with respect to a housing centerline axis equal to the motor propeller blade pitch with respect to the same axis.

14 Claims, 4 Drawing Sheets

102
60
60
60
104
10
100

12
12
40

104
200
100
102
300
300
10

102
60
104
10
30
24
34
100

40
12
12

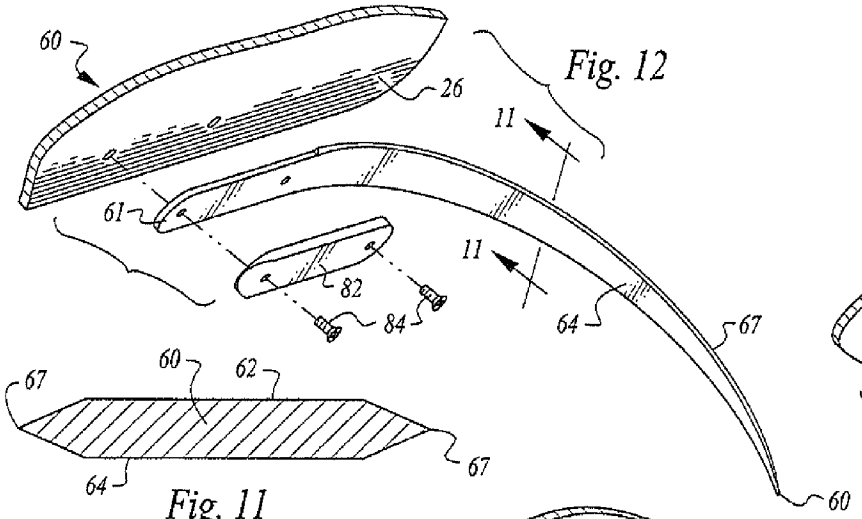
Fig. 12
Fig. 11
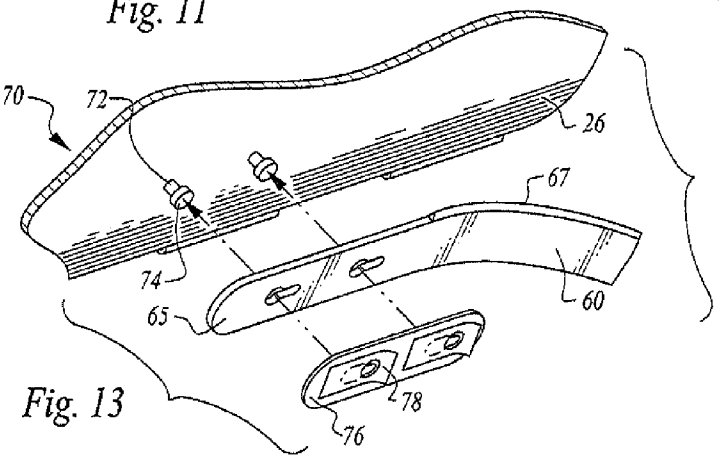
Fig. 13
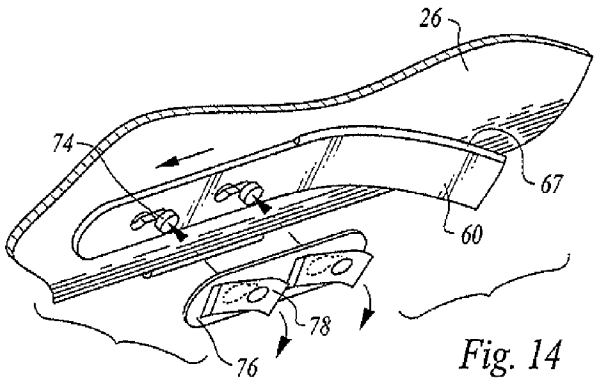
Fig. 14
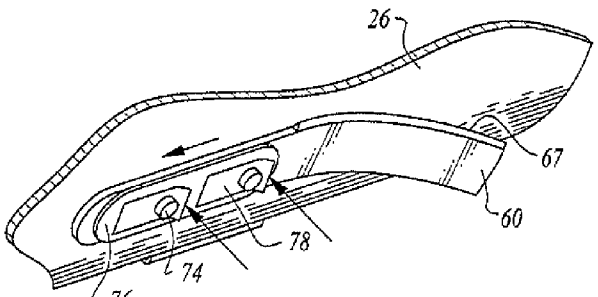
Fig. 15

CUTTER ASSEMBLY FOR A MOTOR PROPELLER

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

The present invention relates generally to the field of boat motor propellers and, more specifically, to an electric trolling motor housing which includes a plurality of blades to cut underwater growth before the underwater growth can wrap around the propeller and stop or damage the propeller motor.

STATEMENT REGARDING COPYRIGHT/TRADEMARK

At least a portion of the disclosure of this document may contain material, which is subject to copyright/trademark protection. The copyright/trademark owner has no objection to the facsimile reproduction by anyone of the patent document or the patent disclosure, as it appears in the Patent and Trademark Office patent file or records, but otherwise reserves all copyright/trademark rights whatsoever.

BACKGROUND OF THE INVENTION

Fresh water sport fishing has grown immensely in sophistication and popularity. The sporting pursuit of gamefish has become a profession to many and an extensive hobby with a large portion of the populace. These gamefish tend to concentrate around cover in the water, and often the thicker the cover, more and larger gamefish. Cover is considered to be any of a variety of things, either natural or manmade, in the water which serve to hide or protect the fish in their aquatic environs. One of the thickest forms of cover is grass particularly in more southern parts of the country. Many species of grass exist in natural and manmade lakes, and the grass in many cases can become so thick as to make navigation difficult or impossible.

Because underwater grass is such an excellent cover for fish that anglers often seek to enter even the thickest grass bed in pursuit of trophy gamefish.

An essential accessory on most sport fishing boats is a small, electric motor which is used to maneuver the boat during the fishing. These motors are commonly referred to as trolling motors to distinguish them from the combustion engines which are the primary power for the boat. Trolling motors are quiet and efficient, typically operated by batteries in the boat, and are far more effective during fishing than the larger and powerful combustion engines which are usually used for travel over greater distances. Such electric trolling motors are often mounted on the bow of the boat for use, and steered either by hand or by foot. Indeed, such trolling motors may be used by the fisherman without stopping his fishing or without taking his line out of the water.

Indeed, such electric trolling motors are frequently the only type of motors permitted on numerous small fishing lakes, as these motors permit the boat to travel around the lake, but with almost no wake or noise.

One of the disadvantages of electric trolling motors, however, is the fact that the propellers can be quickly tangled with underwater growth, including grasses, to the point where the motor does not have enough power to turn propellers or the trolling motor seizes and is ruined. This is a particularly problem in lakes where grass grows thickly year round. In order for an electric trolling motor to operate efficiently, it must have a continuous flow of water. The thick grass cover blocks this flow, thereby preventing the motor from functioning properly or efficiently.

When the disruptions or failures occur to the electric trolling motor during the sport of game fishing valuable contest time limits are lost in trying to rectify the trolling motor issues. There are additional personal safety and property damage concerns when a sport game fishing boat is rendered powerless in wake or choppy water conditions.

Thus, there is a need for an improved cutter assembly for a motor propeller that can be easily manufactured, assembled, and effectively used to increase sport game fishing safety and enjoyment.

An objective of an embodiment of the cutter assembly for a motor propeller is to provide protection for an electric trolling motor that works in any electric trolling motor direction.

Yet another objective of an embodiment of the cutter assembly for a motor propeller is to provide protection for an electric trolling motor that draws grass towards the cutting assembly.

Another objective of an embodiment of the cutter assembly for a motor propeller is to provide protection for an electric trolling motor which includes improved cutting blade orientation with respect to the propulsive effects of an electric trolling motor propeller.

A further objective of an embodiment of the cutter assembly for a motor propeller is to provide protection for an electric trolling motor that allows maneuvering through thick vegetative underwater cover.

Yet a further objective of an embodiment of the cutter assembly for a motor propeller is to provide protection for an electric trolling motor that can be quickly adapted to existing electric trolling motors, and quickly removed from the same for maintenance or when a trolling motor is not needed.

Another objective of an embodiment of the cutter assembly for a motor propeller is to provide protection for an electric trolling motor which includes quick release cutting blades.

DISCLOSURE OF INVENTION

The cutter assembly for a motor propeller works in conjunction with the propeller's propulsion to cut aquatic vegetation and deflect the cut vegetation from the operation of the propeller blade. An embodiment of the cutter assembly provides cover halves with external surfaces and internal surfaces sized to fit around a cylindrical motor housing. The cover halves are joined one to the other by at least one top lift off hinge and at least one releasable bottom releasable external fastener. The hinge(s) and fastener(s) allow the cover halves to open and receive the cylindrical motor housing, to close around the cylindrical motor housing, and to lock onto the cylindrical motor housing. The locked halves provide a cylindrical cover around the cylindrical motor housing.

In Four equal sized curved cutting blades each having dual cutting edges, a cutting blade surface having a concave portion, and a cutting blade surface having a convex portion are spaced equidistant around the cylindrical cover at equal distance from the cylindrical cover end proximate to the propeller. These curved cutting blades are attached to the external surface of the cylindrical cover such that each cutting blade is ninety degrees from its adjacent cutting blades with respect to a longitudinal central axis of the cylindrical cover. The orientation of each cutting blade is forty-five degrees from an axis orthogonal to the cylindrical cover longitudinal central axis, such that each cutting blade surface having a concave portion faces the cover forward end, and such that each cutting blade surface having a convex portion faces the cover end proximate to the propeller.

An alternative embodiment provides the four curved cutting blades each having dual cutting edges, a cutting blade surface having a concave portion, and a cutting blade surface having a convex portion are spaced equidistant around the cylindrical motor housing. These curved cutting blades are attached to the external surface of the cylindrical motor housing such that each cutting blade is ninety degrees from its adjacent cutting blades with respect to a longitudinal central axis of the cylindrical motor housing. The orientation of each cutting blade is forty-five degrees from an axis orthogonal to the cylindrical motor housing longitudinal central axis, such that each cutting blade surface having a concave portion faces the cylindrical motor housing forward end, and such that each cutting blade surface having a convex portion faces the cylindrical motor housing end proximate to the propeller.

As configured, the cutter assembly for a motor propeller cuts the vegetation drawn across and transverse to the curved cutting blades by the propulsion of the trolling motor propeller.

BRIEF DESCRIPTION OF DRAWINGS

FIG. 11 depicts a cross section of FIG. 12 taken at "11-11."

FIG. 12 provides a representative detail of a cutting blade 60 fastener attachment assembly 80 to the exterior surface 26 of the cylindrical cover 20 for an embodiment of the improved cutter assembly 10 for a motor propeller 102.

FIG. 13 depicts an exploded perspective view of a representative detail for an alternative quick release cutting blade 60 attachment assembly 70 to the exterior surface 26 of the cylindrical cover 20 for an embodiment of the improved cutter assembly 10 for a motor propeller 102.

FIG. 14 depicts a perspective view of the alternative quick release cutting blade 60 attachment assembly 70 of FIG. 13, whereby the cutting blade 60 is positionally fitted onto support posts 72 on the cylindrical cover 20 exterior surface 26 for the embodiment of the improved cutter assembly 10 for a motor propeller 102.

FIG. 15 depicts a perspective view of the alternative quick release cutter blade 60 attachment assembly 70 of FIG. 14, whereby the positionally fitted cutting blade 60 support base 65 is locked onto the support posts 72 on the exterior surface 26 of the cylindrical cover 20 for an embodiment of the improved cutter assembly 10 for a motor propeller 102 of FIG. 14 by a sliding locking plate 76 having spring elements sized to receive and secure the support post 72 caps 74.

BEST MODE FOR CARRYING OUT THE INVENTION

Referring now to FIGS. 1-18, embodiments of an improved cutter assembly 10 or 110 for a motor propeller 102 are illustrated and disclosed.

Figures 1, 2, 3, 4, 5:
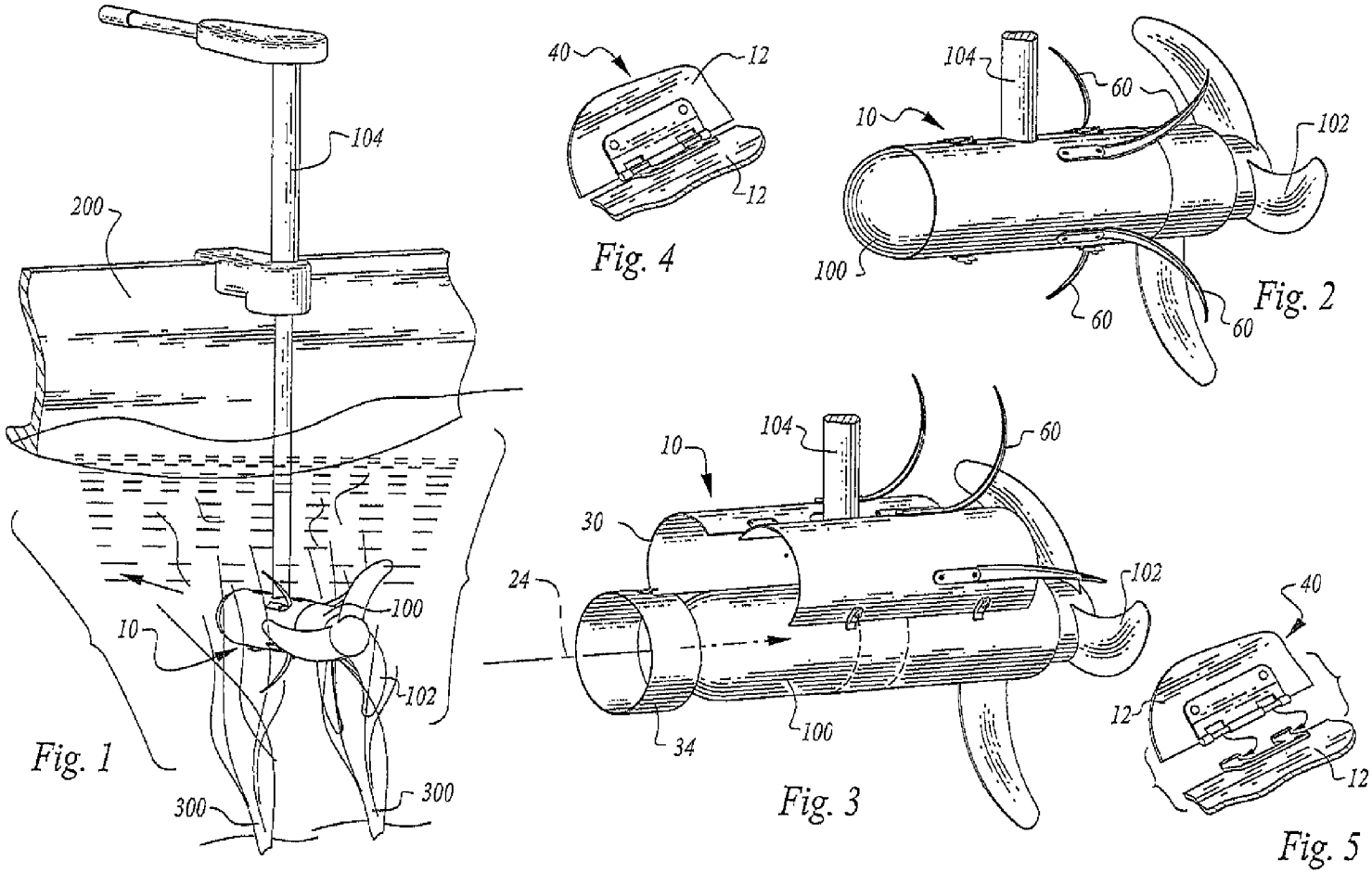
FIG. 1 depicts a perspective view of boat 200 having an electric trolling motor that provides a cylindrical motor housing 100 equipped with an embodiment of an improved cutter assembly 10 for a motor propeller 102 that allows maneuvering through thick vegetative underwater cover 300 without the vegetation wrapping around the propeller.
FIG. 2 depicts a perspective view of the cylindrical motor housing 100 of FIG. 1 with an embodiment of an improved cutter assembly 10 for a motor propeller 102 attached to the cylindrical motor housing 100, and providing four cutting blades 60.
FIG. 3 depicts a perspective view of an embodiment of an improved cutter assembly 10 for a motor propeller 102 and at least one gasket 34 being fitted onto the cylindrical motor housing 100 of FIG. 2 before the improved cutter assembly 10 is positioned around and locked onto the cylindrical motor housing 100.
FIG. 4 depicts a perspective detail view of lift-off type hinge assembly 40 for the embodiment of an improved cutter assembly 10 for a motor propeller 102 of FIG. 3, showing the hinge assembly connecting cover halve 12 top edges.
FIG. 5 depicts a perspective detail view of off the lift-off type hinge assembly 40 of FIG. 4 for an embodiment of an improved cutter assembly 10 for a motor propeller 102 showing the disconnected hinge assembly 40 on separated cover halves 12 top edges.
Figure 6:
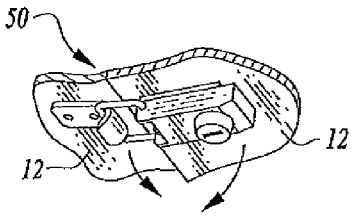
FIG. 6 depicts a perspective detail view of a fastener assembly 50 for an embodiment of an improved cutter assembly 10 for a motor propeller 102 of FIG. 3, showing the fastener assembly 50 connecting cover halve 12 bottom edges.
Figure 7:
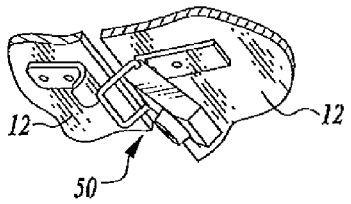
FIG. 7 depicts a perspective detail view of off the fastener assembly 50 of FIG. 6 for an embodiment of an improved cutter assembly 10 for a motor propeller 102 showing the disconnected fastener assembly 50 on separated cover halves 12 bottom edges.
Figure 8:
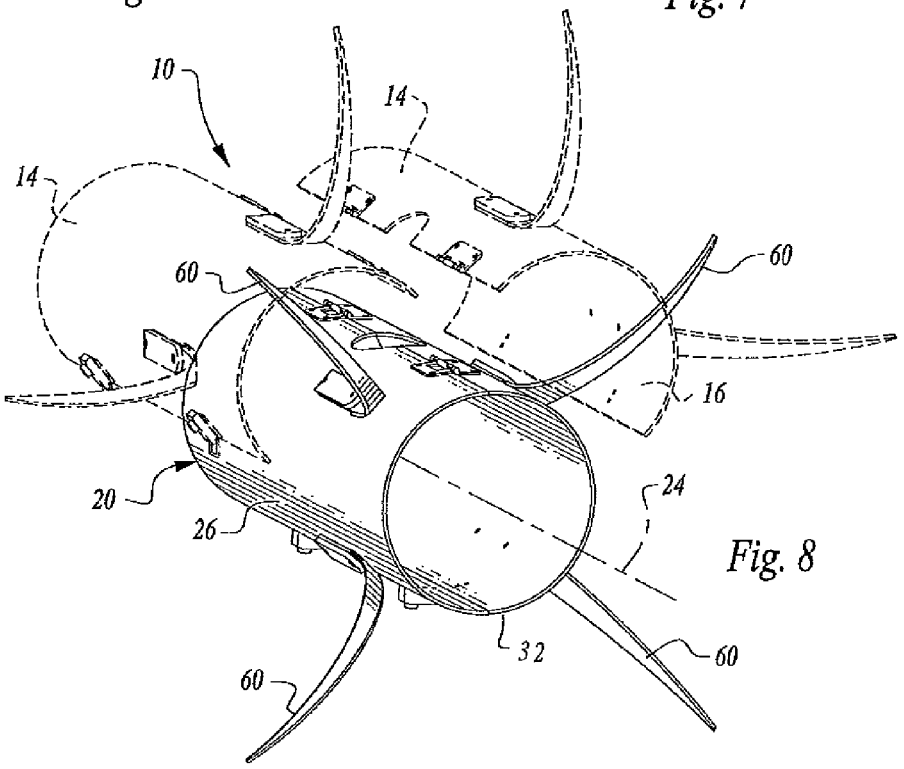
FIG. 8 depicts an exploded perspective view of an embodiment of an improved cutter assembly 10 for a motor propeller 102 showing the closing motion of the cutter assembly 10 about at least one top side hinge assembly 40, and the locking of the cutter assembly 10 together by at least one bottom side locking assembly 50, whereby four cutting blades 60 are attached to the cylindrical cover 20 external surface 26 such that each cutting blade 60 is equidistant from adjacent cutting blades 60 with respect to the cylindrical cover 20 longitudinal central axis 24.

An embodiment of the cutter assembly 10 for a motor propeller 102 includes cover halves 12 having external surfaces 14 and internal surfaces 16 sized to fit around a cylindrical motor housing 100, FIGS. 1-3. The cover halves 12 are joined one to the other by at least one top hinge assembly 40 and at least one bottom releasable external fastener assembly 50, FIGS. 4-9. This joinder of the cover halves 12 allows the cover halves 12 to open and receive the cylindrical motor housing 100, to close around the cylindrical motor housing 100, and lock onto the cylindrical motor housing 100, FIGS. 1-3, 8 and 9. Thus, the locked cover halves 12 form a cylindrical cover 20 around the cylindrical motor housing 100, FIGS. 1-3. The cylindrical cover 20 defines a longitudinal central axis 24, FIGS. 2 and 8, and includes a cylindrical cover top side opening 22 comprising a diameter large enough to receive a vertically disposed shaft 104 attached to a top side of the cylindrical motor housing 100, FIGS. 2, 3 and 8. As depicted in FIG. 2, the cylindrical cover 20 longitudinal central axis 24 corresponds to the longitudinal central axis of the cylindrical motor housing 100. The cylindrical cover 20 further provides an internal surface 28, an external surface 26, a forward end 30, and an aft end 32 proximate to the motor propeller 102, FIGS. 2, 3 and 8.

The embodiment of the cutter assembly 10 for a motor propeller 102 also includes four equal sized cutting blades 60. Each cutting blade 60 provides a pair of cutting edges 63 positioned on either side of a cutting blade surface 64 having a concave portion, and cutting blade surface 62 having a convex portion. The cutting blade 60 surface 64 and surface 62 taper to a cutting blade tip end. For an embodiment of the cutter assembly 10 for a motor propeller 102 having blades with a ninety degree or vertical pitch relative to the longitudinal central axis 24, FIGS. 8-10, the cutting blade surfaces, 62 and 64, and the cutting edges 63 at the cutting blade tip end are orthogonal to the longitudinal central axis 24. The cutting blades 60 are spaced equidistant around the cylindrical cover 20 external surface 26, such that each cutting blade 60 cutting edge 63 is disposed transverse to a plane rotated around the longitudinal central axis 24. The cutting blades 60 are attached to the cylindrical cover 20 external surface 26 at equal distance from the cylindrical cover 20 aft end 32 proximate to the motor propeller 102. The cutting blades 60 likewise are attached to the cylindrical cover 20 external surface 26 such that each cutting blade 60 is ninety degrees from adjacent cutting blades 60 with respect to the cylindrical cover 20 longitudinal central axis 24. In this manner, the orientation of each cutting blade 60 is forty-five degrees from an axis orthogonal to the cylindrical cover 20 longitudinal central axis 24, FIG. 9. Each cutting blade 60 surface 64 having a concave portion faces the cylindrical cover 20 forward end 30. Each cutting blade 60 surface 62 having a convex portion faces the cylindrical cover 20 aft end 32 proximate to the motor propeller 102.

Figure 10:
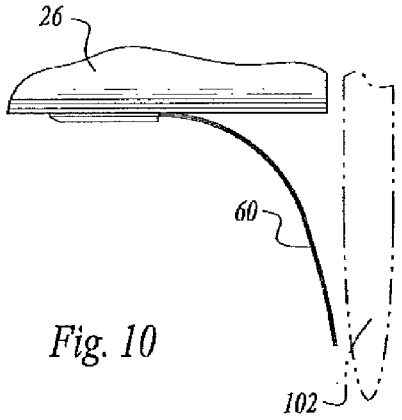
FIG. 10 depicts a planar side view of a cutting blade 60 attached to the exterior surface 26 of the cylindrical cover 20 of FIG. 9 taken at "10-10" for an embodiment of the improved cutter assembly 10 for a motor propeller 102 having vertically disposed motor propeller 102 blades, where the angle of the cutting blade tip end is parallel to the pitch of the blades of the motor propeller, and that for vertically disposed motor propeller blades, the cutting blade tip end is orthogonal to the cylindrical cover 20 longitudinal central axis 24, e.g., FIG. 3.
Figure 17:
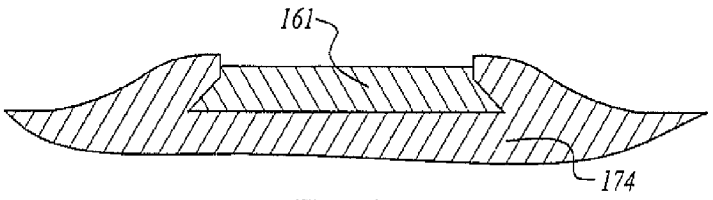
FIG. 17 is a detailed view of the embodiment of an improved cutter assembly 110 of FIG. 16 taken at "17-17."

Testing indicates the optimum cutting effectiveness from propeller propulsion is attained when the angle of the cutting blade tip end is parallel to the pitch of the blades of the motor propeller 102. As shown in FIG. 10, for vertically disposed motor propeller blades, the cutting blade tip end is orthogonal to the cylindrical cover 20 longitudinal central axis 24, e.g., FIG. 3. If the pitch of the motor propeller blades was seventy degrees in relation to the cylindrical cover 20 longitudinal central axis 24, optimum cutting effectiveness from propeller propulsion would be attained with a cutting blade tip end is also disposed seventy degrees from the cylindrical cover 20 longitudinal central axis 24, and so on. Cutting blades 60 will be manufactured to adapt to the variety of propeller blade pitches in the marketplace. It will be understood that the range of angle for propeller pitch and corresponding cutting blade tip end in relation to the cylindrical cover 20 longitudinal central axis 24 typically is between sixty (60°) degrees and ninety (90°) degrees. This angle for propeller pitch and corresponding cutting blade tip end in relation to the cylindrical cover 20 longitudinal central axis 24 would not be more than ninety (90°) degrees. This optimal cutting blade tip end angle relative to the motor propeller and cylindrical cover 20 longitudinal central axis 24 also ensures that the optimum cutting effectiveness is maintained when motor propeller 102 rotation is reversed.

An embodiment of the improved cutter assembly 10 for a motor propeller 102, FIG. 12, provides a cutting blade 60 fastener attachment assembly 80 to the exterior surface 26 of the cylindrical cover 20. The cutting blade 60 fastener attachment assembly 80 includes a cutting blade 60 support base 63 and a top plate 82 fixedly attached to the exterior surface 26 of the cylindrical cover 20 by at least one threaded fastener 84.

An alternative embodiment of the improved cutter assembly 10 for a motor propeller 102, FIGS. 13-15, provides a quick release cutting blade 60 attachment assembly 70 to the exterior surface 26 of the cylindrical cover 20. The quick release cutting blade 60 attachment assembly 70 includes support posts 72 with post caps 74 extending from the exterior surface 26 of the cylindrical cover 20. A cutting blade 60 support base 65 is positionally fitted onto support posts 72, and secured onto the support posts 72 by sliding the support base 65 towards the cylindrical cover 20 forward end 30. The support base 64 is then locked onto the JO support posts 72 by sliding a locking plate 76 having spring elements 78 sized to receive and secure the support post 72 caps 74, towards the cylindrical cover 20 forward end 30 thereby securing the cutting blade 60 to the cylindrical cover 20. The cutting blade 60 is quickly removed from the cylindrical cover 20 by depressing the spring elements 78, sliding the locking plate 76 towards the aft end 32 of the cylindrical cover 20, then similarly sliding the cutting blade 60 support base 65 towards the aft end 32 of the cylindrical cover 20, and lifting the cutting blade 60 support base 65 off the support posts 72.

An embodiment of the improved cutter assembly 10 for a motor propeller 102, FIG. 12, provides a gasket 34 sized to be received on the cylindrical motor housing 100 before the cover halves 12 are closed around the cylindrical motor housing 100. The gasket 34 includes a notched aft end portion sized to clear the vertically disposed shaft 104 attached to a top side of the cylindrical motor housing 100 as the gasket is positioned onto the cylindrical motor housing 100. Thus positioned, the gasket 34 serves to prevent any movement of the cutting blades from the initial angular positions described in FIG. 9 with respect to the longitudinal central axis 24, e.g. FIG. 2, during operation of the improved cutter assembly 10 for a motor propeller 102.

Figure 16:
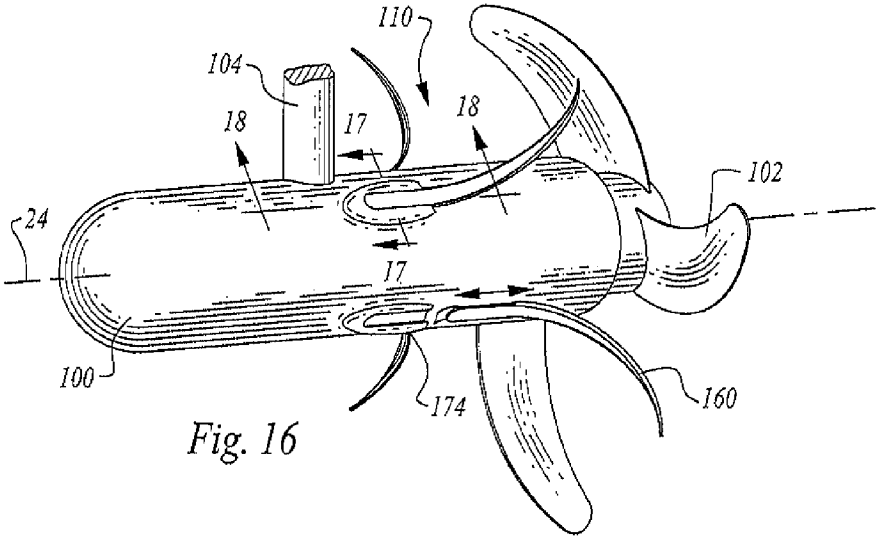
FIG. 16 depicts a perspective view of a cylindrical motor housing 100 with an embodiment of an improved cutter assembly 110 for a motor propeller 102 directly attached to the cylindrical motor housing 100, whereby four cutting blades 160 are attached to the cylindrical motor housing 100 external surface such that each cutting blade 160 is equidistant from adjacent cutting blades 160 with respect to the cylindrical motor housing 100 longitudinal central axis 24.
Figure 18:
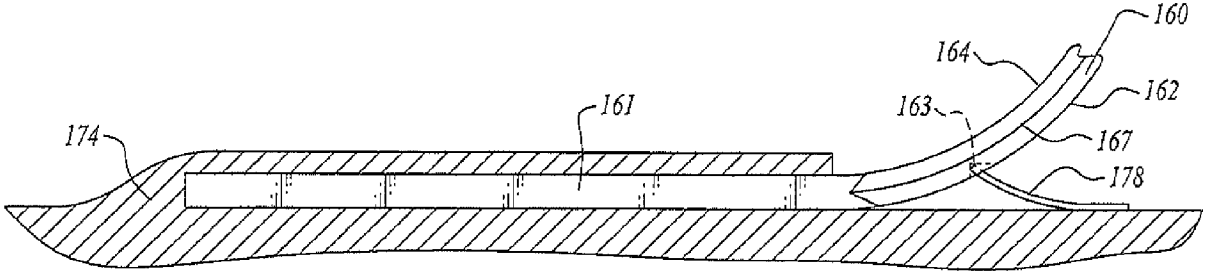
FIG. 18 is a detailed view of the embodiment of an improved cutter assembly 110 of FIG. 16 taken at "18-18."

An embodiment of an improved cutter assembly 110 for a motor propeller 102 that is directly attached to the cylindrical motor housing 100 includes four cutting blades 160, FIG. 16. Each cutting blade 160 provides a pair of cutting edges 163 positioned on either side of a cutting blade surface 164 having a concave portion and a cutting blade surface 162 having a convex portion. Each cutting blade 160 surface 164 and surface 162 taper to a cutting blade tip end. Each cutting blade 160 base end 161 is sized to be received by and adaptively fit into a cylindrical motor housing 100 mounting element 174 integral to the cylindrical motor housing 100 exterior surface, FIGS. 16-18. Each cutting blade 160 base end 161 is held in the cylindrical motor housing 100 mounting element 174 by a spring pin 178 having one end attached to the mounting element 174 and having another end engaged in a receiving notch 163 of the cutting blade 160 convex cutting blade surface near the cutting blade 160 base end 161, FIG. 18. The cutting blade 160 base end 161 bottom surface presents a wider width dimension than the cutting blade 160 base end 161 top surface corresponding to similar width dimensions of the cylindrical motor housing 100 mounting element 174, FIG. 17, to securely hold the cutting blade 160 base end 161 within the cylindrical motor housing 100 mounting element 174 when the spring pin 178 has engaged the receiving notch 163, FIG. 18. The cutting blade 160 is quickly and easily removed from the cylindrical motor housing 100 mounting element 174 by releasing the spring pin 178 from the receiving notch 163, and sliding the cutting blade 160 base end 161 from the cylindrical motor housing 100 mounting element 174. In this fashion, dull or broken cutting blades easily can be replaced, or the entire set of cutting blades removed for motor use outside the grassy cover environments.

Figure 9:
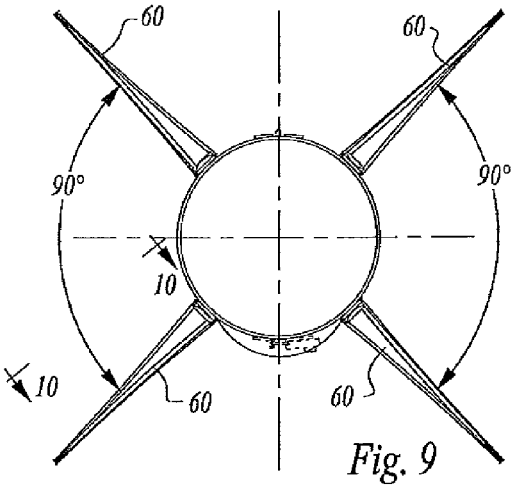
FIG. 9 depicts a planar end view of the cylindrical cover 20 and the cutting blade 60 attachment thereto for an embodiment of the improved cutter assembly 10 for a motor propeller 102 of FIG. 8, depicting that each cutting blade 60 is ninety degrees from adjacent cutting blades 60 with respect to the cylindrical cover 20 longitudinal central axis 24, and that each cutting blade 60 is forty-five degrees from an axis orthogonal to the longitudinal central axis 24.

The arrangement of the cutting blades 160 each fitted within cylindrical motor housing 100 mounting element 174 around the cylindrical motor housing 100 is similar to the embodiment of an improved cutter assembly 10, as depicted in FIGS. 9 and 10, such that each cutting blade 160 is ninety degrees from adjacent cutting blades 160 with respect to the cylindrical motor housing longitudinal central axis 24. In this manner, the orientation of each cutting blade 160 is forty-five degrees from an axis orthogonal to the cylindrical cover 20 longitudinal central axis 24. Each cutting blade 160 surface 164 having a concave portion faces the cylindrical motor housing 100 forward end. Each cutting blade 160 surface 162 having a convex portion faces the aft end cylindrical motor housing 100 proximate to the motor propeller 102, FIGS. 9, 10 and 16-18.

Likewise, the same optimum cutting effectiveness from propeller propulsion that is attained when the angle of the cutting blade tip end is parallel to the pitch of the blades of the motor propeller 102, as shown in FIG. 10 for the embodiment of the improved cutter assembly 10, applies for cutting blades 160 for the embodiment of an improved cutter assembly 110 affixed to the cylindrical motor housing 100. Cutting blades 160 will be manufactured to adapt to the variety of propeller blade pitches in the marketplace. It will be understood that the range of angle for propeller pitch and corresponding cutting blade in relation to the cylindrical motor housing 100 longitudinal central axis 24 typically is between sixty (60°) degrees and ninety (90°) degrees. The angle would not be more than ninety (90°) degrees. This optimal cutting blade angle relative to the motor propeller and cylindrical motor housing 100 longitudinal central axis 24 also ensures that the optimum cutting effectiveness is maintained when motor propeller 102 rotation is reversed.

The cover halves 12 and resulting cylindrical cover 20 can be fabricated from aluminum, graphite or similar high impact carbon based materials. The cutting blades 60, 160 can be fabricated from high quality, extremely hardened steel with thin dual cutting edges 63, 163 carved by lasers. Alternatively, the cutting blades 60, 160 can be fabricated from ceramics, or graphite or similar high impact carbon based materials known to provide and hold nearly razor sharp cutting edges 63, 163. Fastener assemblies 40, 50, 70, 80,174 or 178 can be fabricated from aluminum, stainless steel, graphite or similar high impact carbon based materials.

The gasket 34 can be fabricated from rubber, soft-density plastics, cork, high-strength carbon fibers, hard-pressed woods fibers, or similar high strength, gripping materials. The preferred embodiment of improved cutter assembly 10 includes a rubber gasket 34.

It will be understood that the embodiments of improved cutter assembly 10 and 110 for a trolling motor propeller 102 would be adaptable to the full range of boat trolling motors available in the market either by retrofitting the improved cutter assembly 10 to an existing cylindrical motor housing 100, or by original equipment manufacture of improved cutter assembly 110.

Accordingly, while embodiments for an improved cutter assembly 10 and 110 for a trolling motor propeller 102 are disclosed whereby the cutter assembly has been described as having certain preferred features and embodiments, it will be understood that the cutter assembly is capable of still further variation and modification without departing from the spirit of the cutter assembly, and this application is intended to cover any and all variations, modifications and adaptations of the cutter assembly which fall within the spirit of the invention and the scope of the appended claims.

I claim:

1. A cutter assembly for a motor propeller, the cutter assembly comprising in combination:

a) cover halves comprising external surfaces and internal surfaces sized to fit around a cylindrical motor housing, the cover halves joined one cover half to the other cover half by at least one top hinge assembly and at least one bottom releasable external fastener assembly that allow the cover halves to open and receive the cylindrical motor housing, to close around the cylindrical motor housing, and lock onto the cylindrical motor housing, thus forming a cylindrical cover around the cylindrical motor housing, the cylindrical cover around the cylindrical motor housing comprising a cylindrical cover longitudinal central axis, a cylindrical cover top side opening comprising a diameter large enough to receive a shaft attached to a top side of the cylindrical motor housing, a cylindrical cover internal surface, a cylindrical cover external surface, a cylindrical cover forward end, and a cylindrical cover aft end proximate to a propeller; and b) four equal sized cutting blades, each equal sized cutting blade comprising a cutting blade base, dual cutting blade cutting edges, a cutting blade surface comprising a concave portion, a cutting blade surface comprising a convex portion, and a cutting blade tip end, the four equal sized cutting blades equally spaced around the cylindrical cover external surface, and attached to the cylindrical cover external surface at equal distance from the cylindrical cover aft end proximate to the propeller, such that each cutting blade is ninety degrees from adjacent cutting blades with respect to the cylindrical cover longitudinal central axis, such that an orientation of each cutting blades is forty-five degrees from a vertically oriented plane extending through the cylindrical cover longitudinal central axis, such that each cutting blade surface concave portion faces the cylindrical cover forward end, and such that each cutting blade surface convex portion faces the cylindrical cover aft end proximate to the propeller.

2. The cutter assembly for a motor propeller of claim 1, wherein each cutting blade base further comprises at least one slotted opening, and wherein each cutting blade is attached to the cylindrical cover external surface by a quick release assembly comprising, in combination:

a) at least one support post comprising a support post cap extending orthogonal to the cylindrical cover longitudinal central axis;

b) at least one cutting blade base slotted opening positionally fitted onto the support post cap, secured onto the at least one support post by sliding a support post base towards the cylindrical cover forward end allowing the cutting blade base to be secured by the at least one support post and support post cap;

c) a locking plate comprising at least one spring element sized to receive and secure the support post cap and locking the cutting blade base onto the at least one support post by sliding the locking plate towards the cylindrical cover forward end, whereby each cutting blade is attached to the cylindrical cover, and whereby each cutting blade is released from the cylindrical cover by depressing the locking plate at least one spring element and reversing the sliding orientation of the locking plate and blade base towards the cylindrical cover aft end proximate to the propeller, and lifting the locking plate and the at least one cutting blade base slotted opening from the at least one support post and support post cap.

3. The cutter assembly for a motor propeller of claim 1, further comprising at least one gasket between the cylindrical cover and the cylindrical motor housing.

4. The cutter assembly for a motor propeller of claim 1, wherein the at least one top hinge assembly and the at least one bottom releasable external fastener assembly comprise, in combination:

a) a top plate comprising at least one opening through the top plate corresponding to at least one opening through the cutting blade base; and b) at least one threaded fastener sized to be received in at least one opening through the top plate opening and the at least one opening through the cutting blade base and into a threaded opening in the cylindrical cover, whereby each cutting blade base is fixedly attached to the cylindrical cover equidistant from the cylindrical cover aft end proximate to the propeller.

5. A cutter assembly for a motor propeller, the cutter assembly comprising in combination:

a) four equal sized cutting blades, each cutting blade comprising a cutting blade base, dual cutting blade edges, a cutting blade surface comprising a concave portion, a cutting blade surface comprising a convex portion, and a cutting blade tip end; and b) a cutter blade fastener attachment assembly for attaching each cutting blade to a motor propeller housing such that the cutting blades are evenly spaced around a longitudinal central axis of the motor propeller housing, such that each cutting blade is equidistant from a motor propeller housing aft end proximate to the motor propeller, and such that dual cutting blade edges for each cutting blade are oriented transverse to the longitudinal central axis of the motor propeller housing;

such that each cutting blade is ninety degrees from adjacent cutting blades with respect to the motor propeller housing longitudinal central axis, such that an orientation of each cutting blade is forty-five degrees from a vertical axis orthogonal to the motor propeller housing longitudinal central axis, such that each cutting blade surface concave portion faces a motor propeller housing forward end, and such that each cutting blade surface convex portion faces a motor propeller housing aft end proximate to the propeller, whereby the cutting blades work in conjunction with propulsion from the motor propeller to cut aquatic vegetation and deflect it from the motor propeller.

6. The cutter assembly for a motor propeller of claim 5, wherein the cutter blade fastener attachment assembly for attaching a plurality of cutting blades to a motor propeller housing comprises in combination:

a) cover halves comprising external surfaces and internal surfaces sized to fit around a cylindrical motor housing, the cover halves joined one cover half to the other cover half by at least one top hinge assembly and at least one bottom releasable external fastener assembly that allow the cover halves to open and receive the cylindrical motor housing, to close around the cylindrical motor housing, and lock onto the cylindrical motor housing, thus forming a cylindrical cover around the cylindrical motor housing, the cylindrical cover around the cylindrical motor housing comprising a cylindrical cover longitudinal central axis, a cylindrical cover top side opening comprising a diameter large enough to receive a shaft attached to a top side of the cylindrical motor housing, a cylindrical cover internal surface, a cylindrical cover external surface, a cylindrical cover forward end, and a cylindrical cover aft end proximate to a propeller;

b) a top plate comprising at least one opening through the top plate corresponding to at least one opening through the cutting blade base; and c) at least one threaded fastener sized to be received in the at least one opening through the top plate opening and the at least one opening through the cutting blade base and into a threaded opening in the cylindrical cover, whereby each cutting blade base is fixedly attached to the cylindrical cover equidistant from the cylindrical cover aft end proximate to the propeller.

7. The cutter assembly for a motor propeller of claim 5, wherein each cutting blade base further comprises at least one cutting blade slotted opening, and wherein means for attaching a plurality of cutting blades to a motor propeller housing comprises in combination:

a) cover halves comprising external surfaces and internal surfaces sized to fit around the cylindrical motor housing, the cover halves joined one cover half to the other cover half by at least one top hinge assembly and at least one bottom releasable external fastener assembly that allow the cover halves to open and receive the cylindrical motor housing, to close around the cylindrical motor housing, and lock onto the cylindrical motor housing, thus forming a cylindrical cover around the cylindrical motor housing, the cylindrical cover around the cylindrical motor housing comprising a cylindrical cover longitudinal central axis, a cylindrical cover top side opening comprising a diameter large enough to receive a shaft attached to a top side of the cylindrical motor housing, a cylindrical cover internal surface, an external surface, a cylindrical cover forward end, and a cylindrical cover aft end proximate to a propeller;

b) at least one support post comprising a support post cap extending orthogonal to the cylindrical cover longitudinal central axis;

c) at least one cutting blade base slotted opening positionally fitted onto the support post cap, secured onto the at least one support post by sliding a support post base towards the cylindrical cover forward end allowing the cutting blade base to be secured by the at least one support post and support post cap;

d) a locking plate comprising at least one spring element sized to receive and secure the at least one support post cap and locking the cutting blade base onto the at least one support post by sliding the locking plate towards the cylindrical cover forward end, whereby each cutting blade is attached to the cylindrical cover, and whereby each cutting blade is correspondingly released from the cylindrical cover by depressing the locking plate at least one spring element and reversing a sliding orientation of the locking plate and blade base towards the cylindrical cover aft end proximate to the propeller, and lifting the locking plate and the at least one cutting blade base slotted opening from the at least one support post and support post cap;

such that each cutting blade is ninety degrees from adjacent cutting blades with respect to the cylindrical cover longitudinal central axis, such that an orientation of each cutting blades is forty-five degrees from a vertical axis orthogonal to the cylindrical cover longitudinal central axis, such that each cutting blade dual cutting edges are orthogonal to a plane rotating about the cylindrical cover longitudinal central axis, such that each cutting blade surface concave portion faces the cylindrical cover forward end, and such that each cutting blade surface convex portion faces the cylindrical cover aft end proximate to the propeller.

8. The cutter assembly for a motor propeller of claim 6, further comprising at least one gasket between the cylindrical cover and the cylindrical motor housing.

9. The cutter assembly for a motor propeller of claim 7, further comprising at least one gasket between the cylindrical cover and the cylindrical motor housing.

10. The cutter assembly for a motor propeller of claim 5, wherein each cutting blade further comprises a receiving notch in the cutting blade surface comprising a convex portion near a cutting blade base end, and wherein the cutter blade fastener attachment assembly for attaching a plurality of cutting blades to a motor propeller housing further comprises a quick release feature comprising in combination:

a) four equal sized mounting elements attached or integral to a motor propeller housing top surface equidistant from a motor propeller housing aft end proximate to the motor propeller such that a separate mounting element is ninety degrees from adjacent mounting elements relative to a motor propeller housing central longitudinal axis and oriented forty-five degrees from a vertical plane along the motor propeller housing central longitudinal axis, and comprising an open aft end sized to receive and secure a cutting blade base;

b) a resilient spring pin comprising one end affixed to the mounting element open aft end and one end size to be received into a cutting blade receiving notch, whereby a cutting blade base end is securely held within a cylindrical motor housing mounting element when a spring pin has engaged a receiving notch, and whereby the cutting blade is removed from the cylindrical motor housing mounting element by releasing the spring pin from the receiving notch, and sliding a cutting blade base end from the cylindrical motor housing mounting element;

such that each cutting blade is ninety degrees from adjacent cutting blades with respect to the cylindrical cover longitudinal central axis, such that an orientation of each cutting blades is forty-five degrees from a vertical axis orthogonal to the cylindrical cover longitudinal central axis, such that each cutting blade dual cutting edges are orthogonal to a plane rotating about the cylindrical cover longitudinal central axis, such that each cutting blade surface concave portion faces the cylindrical cover forward end, and such that each cutting blade surface a convex portion faces the cylindrical cover aft end proximate to the propeller.

11. The cutter assembly for a motor propeller of claim 1, wherein an angle of each cutting blade tip end with respect to the longitudinal central axis of the cylindrical cover equals an angle of a pitch of the motor propeller with respect to the longitudinal central axis of the cylindrical cover.

12. The cutter assembly for a motor propeller of claim 11, wherein the angle of each cutting blade tip end with respect to the longitudinal central axis of the cylindrical cover and the angle of the pitch of the motor propeller with respect to the longitudinal central axis of the cylindrical cover are from sixty (60°) degrees to ninety (90°) degrees.

13. The cutter assembly for a motor propeller of claim 5, wherein an angle of each cutting blade tip end with respect to the longitudinal central axis of the motor propeller housing equals an angle of a pitch of the motor propeller with respect to the longitudinal central axis of the motor propeller housing.

14. The cutter assembly for a motor propeller of claim 13, wherein the angle of each cutting blade tip end with respect to the longitudinal central axis of the motor propeller housing and the angle of the pitch of the motor propeller with respect to the longitudinal central axis of the motor propeller housing are from sixty (60°) degrees to ninety (90°) degrees.

* * * * *